US006343699B1

(12) United States Patent
DeCarlo et al.

(10) Patent No.: US 6,343,699 B1
(45) Date of Patent: Feb. 5, 2002

(54) HUMOROUS DESK ACCESSORY

(76) Inventors: Elza Marie DeCarlo, 3449 Ardendale La., Apt. C, Sacramento, CA (US) 95825; Lawrence Stephen Grey, 9961 Township Rd., Browns Valley, CA (US) 95819; Michelle Daneen Prowse, 3616 Pope Ave., Sacramento, CA (US) 95821

( * ) Notice: Subject to any disclaimer, the term of this patent is extended or adjusted under 35 U.S.C. 154(b) by 0 days.

(21) Appl. No.: 09/751,915

(22) Filed: Dec. 26, 2000

(51) Int. Cl.[7] ..... A47F 7/00
(52) U.S. Cl. ..... 211/11
(58) Field of Search ..... 211/11, 10, 69.1, 211/69.5, 13.1; D11/3

(56) References Cited

U.S. PATENT DOCUMENTS 4,802,593 A * 2/1989 Romanos ..... 211/10
4,919,276 A * 4/1990 Kim et al. ..... 211/13
5,601,193 A * 2/1997 Santoya ..... 211/11
5,823,359 A * 10/1998 Harris et al. ..... 211/11

* cited by examiner

*Primary Examiner*—Alvin Chin-Shue
*Assistant Examiner*—Sarah Purol
(74) *Attorney, Agent, or Firm*—Risto A. Rinne, Jr.

(57) ABSTRACT

A device for placement on a desk includes a base portion that is formed of a non-toxic material, preferably a salt. A first inscription is provided on a visible surface of the base portion that specifies a brand name of prescription medication. A second inscription is provided on a visible surface of the base portion that provides an instruction regarding the use of the device. The second inscription is humorous in that the instruction suggests or implies that the base portion might actually be formed of the prescription medication. The base portion is optionally dyed to better match the appearance of the prescription medication. An optional slot is provided in the base portion to retain business cards therein. An optional first recess is provided in the base portion to retain pens and pencils therein. An optional second recess is provided in the base portion that includes a concave shape and is useful to retain smaller objects, like coins and paper clips therein. A humorous necklace is also described that is formed of a salt and which also includes a modified first and a modified second inscription and a cord for retaining the necklace proximate a person.

19 Claims, 1 Drawing Sheet

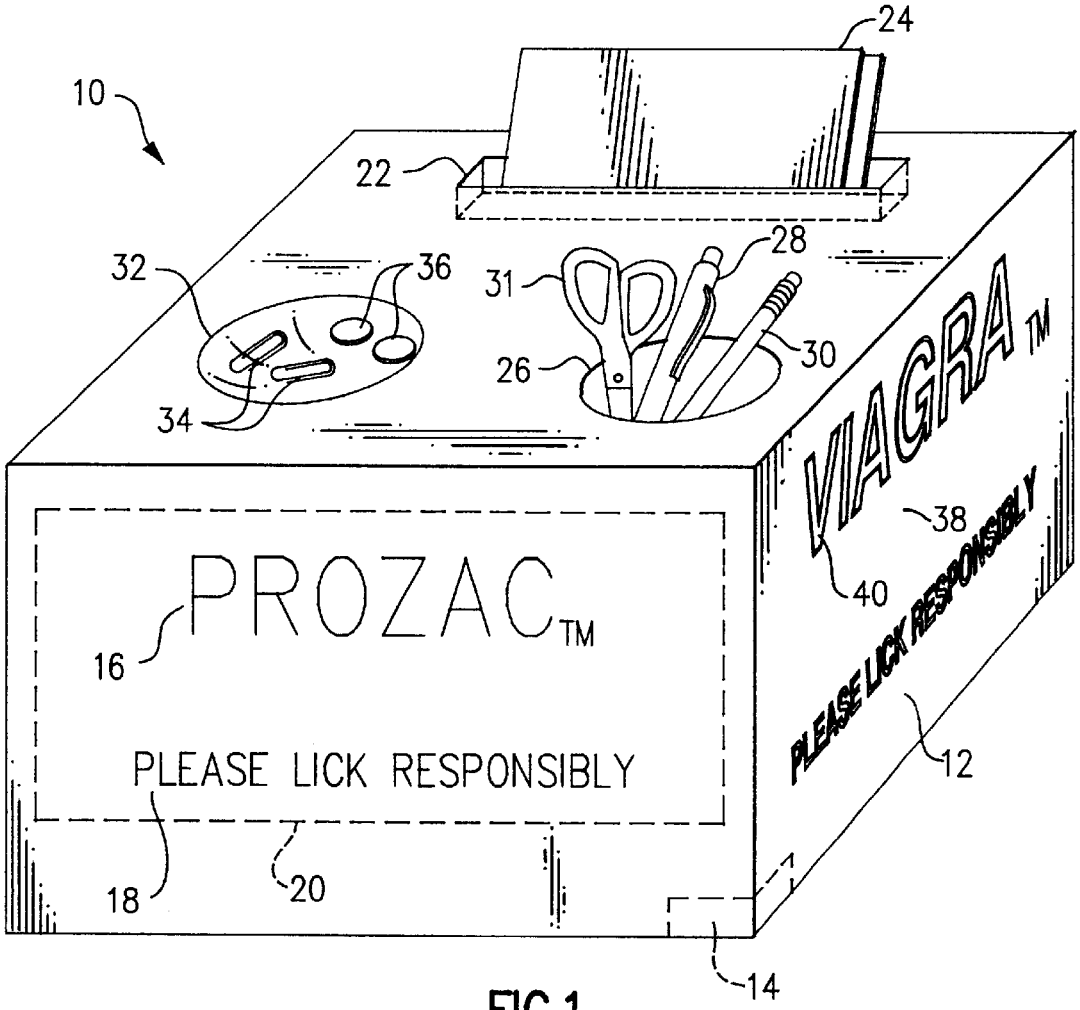
FIG.1
PROZAC™
VIAGRA™
VALIUM™
PAXIL™
VOLOFT™
XANAX™
FIG.2
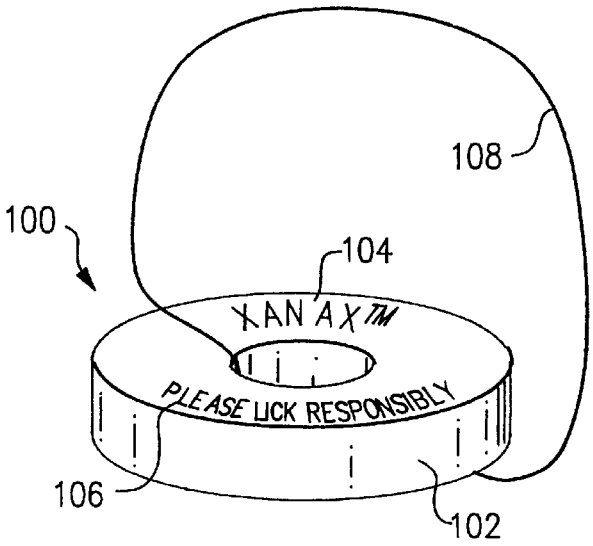
FIG.3

HUMOROUS DESK ACCESSORY

BACKGROUND OF THE INVENTION

1. Field of the Invention

The present invention, in general relates to desk accessories and, more particularly, to devices that hold pencils, scissors and the like or which are humorous.

A desk reflects the personality of the person that uses it. Most jobs that require an individual to spend considerable time at a desk incur stress. There are few people with "desk jobs" who would not agree that they do in fact encounter stress on a daily basis.

Stress can cause depression and more serious forms of depression often require medication. Current estimates suggest that nearly ten percent of the population of the United States is taking, or has at some time taken, some sort of an anti-depressant medication.

There is a stigma association with the use of anti-depressant medications, in particular, and other types of medication generally. Many people feel ashamed of the mere fact that they are required to take medication.

It does not matter what the malady, people often feel inferior due to their reliance upon medication. For example, patients who suffer from impotence and are required to take medication, such as VIAGRA, are likely to feel bad as well.

It is useful to inform the general public that many people in society rely upon some type of a prescription medication to better cope with daily stress (i.e., anti-depressants) or to cope with other physical and psychological maladies.

If this were done in a humorous way, there would be a lessened negative stigma associated with their use. Accordingly, increased usage would likely occur and this would better meet the physical and psychological needs of other patients who currently resist taking medication but stand to benefit from doing so.

Also there is a need for a desk accessory to hold normal desk accessories, such as scissors, pens, or pencils, as well as business cards.

There is also a special need in that a moment of humor during an initial business meeting can instill trust and camaraderie amongst the parties and this can result in a willingness to persist through obstacles sufficient to reach an accord and conduct business.

For example, if a device that dispensed a business card to a prospective client which was placed on a desk was also humorous, then there would likely be an initial exchange between the client and the person having the business card that was positive. Humor diffuses tense situations and makes people feel comfortable. This could be a boon to closings (i.e., making sales) and to doing business, in general.

Clearly, a device that can be placed on a desk and which is useful in reducing stress, or making light of it, and which also lessens negative stigma of taking medications and which helps to express just how common (i.e., widespread) their actual consumption already is would be an especially useful and valuable device.

Similarly, a necklace that can also reduce stress and add humor is desirable.

2. Description of Prior Art

Desk accessories are, in general, are well known types of devices. While the structural arrangements of the these types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a humorous desk accessory that includes a consumable substance.

It is also an important object of the invention to provide a humorous desk accessory that is made of a type of salt.

Another object of the invention is to provide a humorous desk accessory that is made of sodium chloride.

Still another object of the invention is to provide a humorous desk accessory that can be used to hold desk accessories.

Still yet another object of the invention is to provide a humorous desk accessory that can hold a business card.

Yet another important object of the invention is to provide a humorous desk accessory that that can hold pens or pencils or a pair of scissors.

Still yet another important object of the invention is to provide a humorous desk accessory that includes an inscription.

Still yet one other important object of the invention is to provide a humorous desk accessory that can serve as a paper weight.

It is one further object of the invention to provide a humorous necklace.

Briefly, a humorous desk accessory that is constructed in accordance with the principles of the present invention has a base portion that is formed of a non-toxic substance, such as ordinary table salt (sodium chloride, NaCl). It is either natural in color (i.e., white) or it is dyed as desired. A first inscription that identifies a well known brand name for a particular medication is visibly included on an exposed surface along with a humorous second inscription that speaks to its use, such as the phrase, "Please lick responsibly". The base portion includes optional recesses, as desired, to hold scissors, pens, pencils, and business cards. A humorous necklace is provided, according to a different embodiment.

BRIEF DESCRIPTION OF THE DRAWINGS

FIG. 1 is a view in perspective of a humorous desk accessory.

FIG. 2 is a table of a portion of the brand name (i.e., tradename) medications that are used to form a first inscription of the humorous desk accessory.

FIG. 3 is a view in perspective of a humorous necklace.

DETAILED DESCRIPTION OF THE INVENTION

Referring to FIG. 1 is shown, a humorous desk accessory, identified in general by the reference numeral 10.

The humorous desk accessory 10 includes a base portion 12 that includes a three-dimensional block of any preferred shape and size that is formed of a non-toxic material.

The preferred non-toxic material for the humorous desk accessory 10 is a block that is formed of ordinary salt, such as table salt or sodium chloride (NaCl). The formation of salt into a solid block is well known and includes the manufacture of "salt-licks" that are currently produced for consumption by livestock. Salt-licks are available in a variety of sizes and shapes.

A dyed portion 14 may be included that includes a dye that is used to color the base portion, as desired. The dyed portion 14 may include a portion of the overall size of the base portion 12 or it may be expanded so as to include the entire base portion 12.

A first inscription 16 that identifies a well known brand name (i.e., a tradename) for a particular medication is visibly included on an exposed surface.

Referring momentarily to FIG. 2, a variety of possible brand name medications for use as the first inscription 16 are shown including PROZAC™, VIAGRA™, VALIUM™, PAXIL™, ZOLOFT™, XANAX™, and others, as desired.

Displaying the name of a common brand name medication is useful and novel in the construction of the humorous desk accessory 10. It reminds those who see it that these medications are in common use. It further creates the illusion that the base portion 12 is actually formed of the same substance that is used to create the brand name medication of the first inscription 16.

This is humorous as it suggests that the person displaying the humorous desk accessory 10 is in need of this particular medication. This is especially useful in relieving stress and it further serves to legitimize the use of this particular type of medication, in particular and of medications, generally.

The base portion 12 includes a humorous second inscription 18 that speaks to the use of the first inscription 14, such as the phrase, "Please Lick Responsibly".

The second inscription 18 greatly adds to the humor. Any other preferred phrase that addresses the consumption or use of the item that is specified by the first inscription 14 may be used, as desired.

As the second inscription 18 suggests the actual consumptive use of the humorous desk accessory 10, it is possible that some people will not read any warnings or notifications that state this is a novelty item that is not really intended for consumption.

Accordingly, it is important to use a substance for the formation of the base portion 12 that is non-toxic. Salt is ideal for this for many reasons.

First, it is inexpensive and easy to form into a solid.

Second, it can be dyed as desired to more accurately replicate the color of the actual medication that is identified by the first inscription 16.

Third, in moderate quantities, it is not toxic thereby obviating considerable risk arising from its consumption. Indeed, it can be consumed by those people not restricted in their consumption of salt and may even be necessary for their diet. For example a person may actually wish to lick the humorous desk accessory 10 after intense physical exercise.

Fourth, a person can, for dramatic effect only, lick the base portion 12 as is suggested by the second inscription 18.

Fifth, it can be readily and inexpensively engraved to form either the first inscription 16 or the second inscription 18 or both.

The first inscription 16 and the second inscription 18 may be affixed to the base portion 12 by the use of a label 20 (in dashed lines) that adheres to the base portion 12. The label 20 can also provide any other information as may be desired, including, for example, a warning that the humorous desk accessory 10 is a novelty item that is really not intended for human consumption, as such.

An optional slot 22 is provided in the humorous desk accessory 10 that is sized to hold a plurality of business cards 24.

An optional first recess 26 is provided in the humorous desk accessory 10 that is adapted to hold a pen 28 or a pencil 30 or scissors 31. The first recess 26 is any shape and depth sufficient to retain the pen 28 and the pencil 30 therein. More than the one pen 28 and pencil 30 may be placed in the first recess 26, providing it is large enough.

An optional second recess 32 is provided that preferably includes a concave cross-section that is spherical in shape, similar to the shape of a crater-like indentation. The second recess 32 is adapted to hold small items like paper clips 34 and coins 36. The advantage of the crater-like shape for the second recess 32 is that the small items may be readily grasped by the finger tips and easily extracted from the second recess 32.

A repetition of the first and second inscriptions 16, 18 are engraved in another exposed surface 38 of the humorous desk accessory 10 that specifies another type of a brand name for the first inscription 16 as found in the table of FIG. 2.

This illustrates that a plurality of first and second inscriptions 16, 18 may be included in the base portion 12, as desired, and further that these may include a repetition of any one of the first inscriptions 16 or they may include a variety of the first inscriptions 16, as desired.

It also illustrates that they may be formed by engraving the first and second inscriptions 16, 18 into the base portion 12. The engraved areas may also include a coloring 40 (i.e., a paint) to enhance visibility.

Referring now to FIG. 3, a humorous necklace, identified in general by the reference numeral 100, is shown.

The necklace 100 includes a ring 102 that is similarly formed of a salt. The ring 102 includes a modified first inscription 104 that is formed in an arc around the ring 102 and which also lists the brand name of a prescription medication.

The ring 102 includes a modified second inscription 106 that is also formed in an arc around the ring 102 and which also provides an instruction as to how to use the ring 102.

A cord 108 passes through a center opening 110 in the ring 102. The cord 108 is placed over the neck of a person (not shown) and is used to support the necklace 100.

The modified first inscription 104 and the modified second inscription 106 may be repeated on the opposite side of the ring 102, as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A humorous desk accessory, comprising:

(a) a base portion that is formed of a non-toxic material said non-toxic material adapted for limited consumption;

(b) a first inscription disposed on an exposed surface of said base portion, said first inscription including a brand name of a prescription medication; and (c) a second inscription disposed on an exposed surface of said base portion, said second inscription including a phrase that appertains to the use of said humorous desk accessory.

2. The humorous desk accessory of claim 1 wherein said phrase that appertains to the use of said humorous desk accessory suggests a manner for its consumption.

3. The humorous desk accessory of claim 1 wherein said non-toxic material includes a salt.

4. The humorous desk accessory of claim 3 wherein said salt includes sodium chloride.

5. The humorous desk accessory of claim 1 wherein said first inscription is a prescription medication selected from the group consisting of PROZAC™, VIAGRA™, VALIUM™, PAXIL™, ZOLOFT™, and XANAX™.

6. The humorous desk accessory of claim 1 wherein said second inscription is humorous.

7. The humorous desk accessory of claim 6 wherein said second inscription includes the phrase, "Please Lick Responsibly".

8. The humorous desk accessory of claim 1 wherein said base portion includes a slot, said slot having a length that is greater than a width and a predetermined depth and wherein said slot is adapted to hold at least one business card therein.

9. The humorous desk accessory of claim 1 wherein said base portion includes a first recess.

10. The humorous desk accessory of claim 9 wherein said first recess is adapted to hold at least one pencil therein.

11. The humorous desk accessory of claim 9 wherein said first recess is adapted to hold at least one pen therein.

12. The humorous desk accessory of claim 9 wherein said first recess is adapted to hold at least one pair of scissors therein.

13. The humorous desk accessory of claim 1 wherein said base portion includes a second recess.

14. The humorous desk accessory of claim 13 wherein said second recess includes a shape proximate that of a crater.

15. The humorous desk accessory of claim 14 wherein said crater is adapted to hold a plurality of smaller objects therein.

16. The humorous desk accessory of claim 1 wherein said base portion includes a coloring added thereto.

17. The humorous desk accessory of claim 1 wherein said first inscription is engraved in said base portion.

18. The humorous desk accessory of claim 1 wherein said base portion includes a label affixed thereto.

19. The humorous desk accessory of claim 1 wherein said second inscription is engraved in said base portion.

* * * * *